US005525953A

United States Patent [19]

Okada et al.

[11] Patent Number: 5,525,953

[45] Date of Patent: Jun. 11, 1996

[54] MULTI-PLATE TYPE HIGH FREQUENCY PARALLEL STRIP-LINE CABLE COMPRISING CIRCUIT DEVICE PART INTEGRATEDLY FORMED IN DIELECTRIC BODY OF THE CABLE

[75] Inventors: Takekazu Okada, Kameoka; Kazuya Sayanagi, Osaka; Kiyoshi Nakanishi, Sagamihara, all of Japan

[73] Assignees: Murata Manufacturing Co., Ltd.; Matsushita Electric Industrial Co., Ltd., both of Japan

[21] Appl. No.: 440,887

[22] Filed: May 15, 1995

Related U.S. Application Data

[63] Continuation-in-part of Ser. No. 234,319, Apr. 28, 1994, abandoned.

[30] Foreign Application Priority Data

Apr. 28, 1993 [JP] Japan ..... 5-102797

[51] Int. Cl.[6] ..... H01P 5/00; H01P 1/20; H01P 1/22; H01P 3/08

[52] U.S. Cl. ..... 333/204; 333/81 A; 333/246; 361/789

[58] Field of Search ..... 333/33, 35, 204, 333/81 A, 238, 246, 263, 245, 260; 361/784, 789, 790, 803, 818; 174/38 R

[56] References Cited

U.S. PATENT DOCUMENTS

| | | | |
|---|---|---|---|
| 2,812,501 | 11/1957 | Sommers | 333/238 |
| 2,915,716 | 12/1959 | Hattersley | 333/204 |
| 2,915,718 | 12/1959 | Grieg et al. | 33/238 |
| 3,533,023 | 10/1970 | Friend et al. | 333/246 |
| 3,534,299 | 10/1970 | Eberhardt | 33/238 X |
| 3,691,563 | 9/1972 | Shelton | 333/238 X |
| 4,260,965 | 4/1981 | Nakamura et al. | 333/81 A |
| 5,355,105 | 10/1994 | Angelucci, Sr. | 333/238 |

FOREIGN PATENT DOCUMENTS

| | | | |
|---|---|---|---|
| 25401 | 2/1984 | Japan | 333/81 A |
| 3201 | 1/1985 | Japan | 333/204 |
| 1160702 | 11/1989 | Japan . | |
| 6283908 | 10/1994 | Japan | 333/238 |

OTHER PUBLICATIONS

Handbook of Tri–Plate Microwave Components, Sanders Assoc., 1956, Nashue, N. H., Title page, pp. 3, 23, 32 & 100 relied on, TK7870S3, copy in Gp. 2500.

Matthaei et al., Microwave Filters, Impedance–Matching Structures, and Coupling Structures, Mc–Graw–Hill, N.Y., N.Y., 1964, Title page & p. 362 relied on, TK3226M38.

*Primary Examiner*—Paul Gensler

*Attorney, Agent, or Firm*—Ostrolenk, Faber, Gerb & Soffen

[57] ABSTRACT

In a multi-plate high frequency parallel strip-line cable including a strip-shaped dielectric body made of either an electrical insulating material having a flexibility or another electrical insulating material having a plasticity, the dielectric body is composed of a pair of dielectric layers. A pair of thin-film-shaped earth conductors is formed on both surfaces of the dielectric body so as to oppose to each other, and a thin-film-shaped center conductor is formed between the pair of dielectric layers in the dielectric body so as to be located between a pair of earth conductors. Further, a circuit device part such as an impedance adjusting circuit, a filter, an attenuator or the like is formed between a pair of dielectric layers in the dielectric body so as to be electrically connected with the center conductor, thereby the parallel strip-line cable having either a flexibility or a plasticity. Furthermore, a further dielectric body composed a pair of further dielectric layers may be formed on one earth conductor with a further earth conductor formed thereon. In this case, the circuit device part is formed in the further dielectric body.

20 Claims, 9 Drawing Sheets

MULTI-PLATE TYPE HIGH FREQUENCY PARALLEL STRIP-LINE CABLE COMPRISING CIRCUIT DEVICE PART INTEGRATEDLY FORMED IN DIELECTRIC BODY OF THE CABLE

This is a continuation-in-part of application Ser. No. 08/234,319 filed on Apr. 28, 1994, now abandoned.

BACKGROUND OF THE INVENTION

1. Field of the Invention

The present invention relates to a high frequency parallel strip line cable for transmitting a high frequency signal such as a microwave signal or the like, which has a frequency higher than about 800 MHz, and in particularly, to a triplate or multi-plate type high frequency parallel strip line cable comprising a circuit device part integratedly formed in a dielectric body of the high frequency parallel strip-line cable.

2. Description of the Related Art

FIG. 5 shows a small-sized conventional high frequency apparatus 50 using a conventional coaxial cable 53.

Referring to FIG. 5, inside the small-sized high frequency apparatus 50 such as a movable portable telephone or the like, which is installed within a case body for covering the high frequency apparatus 50, there has been conventionally used the small coaxial cable 53 as a transmission line for connecting a component with another component so as to transmit therebetween a high frequency signal such as a microwave signal or the like. In the case of FIG. 5, the coaxial cable 53 is provided for connecting an antenna 51 through a connector 54 with a circuit device of circuit substrate 52.

With advancement in performances of recent small-sized high frequency apparatuses, there have arisen the following problems:

(a) noises generated within the circuit devices of the small-sized high frequency apparatus influence operations of the high frequency apparatus; and (b) the reflection loss or the like is caused due to mismatching between impedances of the circuit devices.

In order to solve the above-mentioned problems, it may be conceivable to incorporate an additional circuit device such as a noise filter circuit, an impedance matching circuit, or the like into the high frequency apparatus. However, if the additional circuit devices were installed in the high frequency apparatus, the size of the high frequency apparatus would become larger. Thus, it has been difficult to adopt such an arrangement, in particular, in the small-sized high frequency apparatus such as a movable portable telephone.

SUMMARY OF THE INVENTION

An essential object of the present invention is to dissolve the above-mentioned problems, and in particular, to provide a high frequency transmission line cable capable of being freely and easily installed within a small-sized high frequency apparatus such as a movable portable telephone.

Another object of the present invention is to provide a high frequency transmission line cable capable of making a small-sized high frequency apparatus advancement in the performance thereof without enlarging the size thereof.

A further object of the present invention is to provide a high frequency transmission line cable capable of installing an additional circuit device into a small-sized high frequency apparatus such as a movable potable telephone without enlarging the size thereof.

According to the aspect of the present invention, there is provided a triplate high frequency parallel strip-line cable comprising:

a strip-shaped dielectric body made of either an electrical insulating material having a flexibility or another electrical insulating material having a plasticity, said dielectric body composed of a pair of dielectric layers;

a pair of thin-film-shaped earth conductors formed on both surfaces of said dielectric body so as to oppose to each other;

a thin-film-shaped center conductor formed between said pair of dielectric layers in said dielectric body so as to be located between said pair of earth conductors; and a circuit device part formed between said pair of dielectric layers in said dielectric body so as to be electrically connected with said center conductor, thereby said parallel strip-line cable having either a flexibility or a plasticity.

In the above-mentioned high frequency parallel strip-line cable, said dielectric body is preferably made of a fluoride resin having a flexibility, thereby said parallel strip-line cable having a flexibility.

In the above-mentioned high frequency parallel strip-line cable, said dielectric body is preferably made of a polypropylene resin having a plasticity, thereby said parallel strip-line cable having a plasticity.

According to a further aspect of the present invention, there is provided a multi-plate high frequency parallel strip-line cable comprising:

a strip-shaped main dielectric body made of either an electrical insulating material having a flexibility or another electrical insulating material having a plasticity, said main dielectric body composed of a pair of main dielectric layers;

a pair of thin-film-shaped earth conductors formed on both surfaces of said dielectric body so as to oppose to each other;

a thin-film-shaped center conductor formed between said pair of dielectric layers in said dielectric body so as to be located between said pair of earth conductors;

a strip-shaped sub-dielectric body made of either an electrical insulating material having a flexibility or another electrical insulating material having a plasticity, said sub-dielectric body composed of a pair of sub-dielectric layers;

a thin-film-shaped further earth conductor formed on an upper surface of said sub-dielectric body so as to oppose to said earth conductor;

a circuit device part formed between said pair of sub-dielectric layers in said sub-dielectric body; and connecting means for electrically connecting said circuit device part with said center conductor, said connecting means being formed so as to penetrate said main and sub-dielectric bodies, thereby said parallel strip-line cable having either a flexibility or a plasticity.

In the above-mentioned high frequency parallel strip-line cable, each of said main and sub-dielectric bodies is preferably made of a fluoride resin having a flexibility, thereby said parallel strip-line cable having a flexibility.

In the above-mentioned high frequency parallel strip-line cable, each of said main and sub-dielectric bodies is preferably made of a polypropylene resin having a plasticity, thereby said parallel strip-line cable having a plasticity.

In the above-mentioned high frequency parallel strip-line cable, said circuit device part preferably comprises an impedance adjusting circuit.

In the above-mentioned high frequency parallel strip-line cable, said impedance adjusting circuit preferably comprises a stub formed in said dielectric body so as to be connected with said center conductor.

In the above-mentioned high frequency parallel strip-line cable, said circuit device part preferably comprises an attenuator circuit.

In the above-mentioned high frequency parallel strip-line cable, said circuit device part preferably comprises a filter circuit.

In the above-mentioned high frequency parallel strip-line cable, said circuit device part preferably comprises an inductance.

In the above-mentioned high frequency parallel strip-line cable, said circuit device part preferably comprises a resistance.

In the above-mentioned high frequency parallel strip-line cable, said circuit device part preferably comprises a capacitance.

According to the above-mentioned construction of the present invention, the circuit device is integratedly formed with the multi-plate type high frequency parallel strip-line cable, which is a high frequency transmission line, so that the parallel strip-line cable can be freely and easily installed inside of the small-sized high frequency apparatus. Thus, it is no longer necessary to provide hybrid circuit devices in the small-sized high frequency apparatus.

As described above, according to the present invention, since the multi-plate type parallel strip-line cable is formed with the additional circuit device part and has either a plasticity or flexibility, the parallel strip-line cable or the small-sized high frequency apparatus into which the parallel strip-line cable is incorporated can be provided with advanced performance by virtue of added electrical functions of the additional circuit device part. Further, for such advanced performance, the circuit device part is integratedly formed so as to be incorporated into the parallel strip-line cable, and then the parallel strip-line cable is installed inside the small-sized high frequency apparatus. This results in that the circuit device is no longer required to be installed within the small-sized high frequency apparatus as a hybrid device component. As a result, the size of the small-sized high frequency apparatus can be reduced. Accordingly, the high frequency parallel strip-line cable has such a remarkably advantageous effect that the high frequency apparatus can be provided with advanced performance without enlarging the size of the whole construction of the high frequency apparatus.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

The preferred embodiments according to the present invention will be described in detail hereinbelow, with reference to the attached drawings.

First Preferred Embodiment

Figure 1:
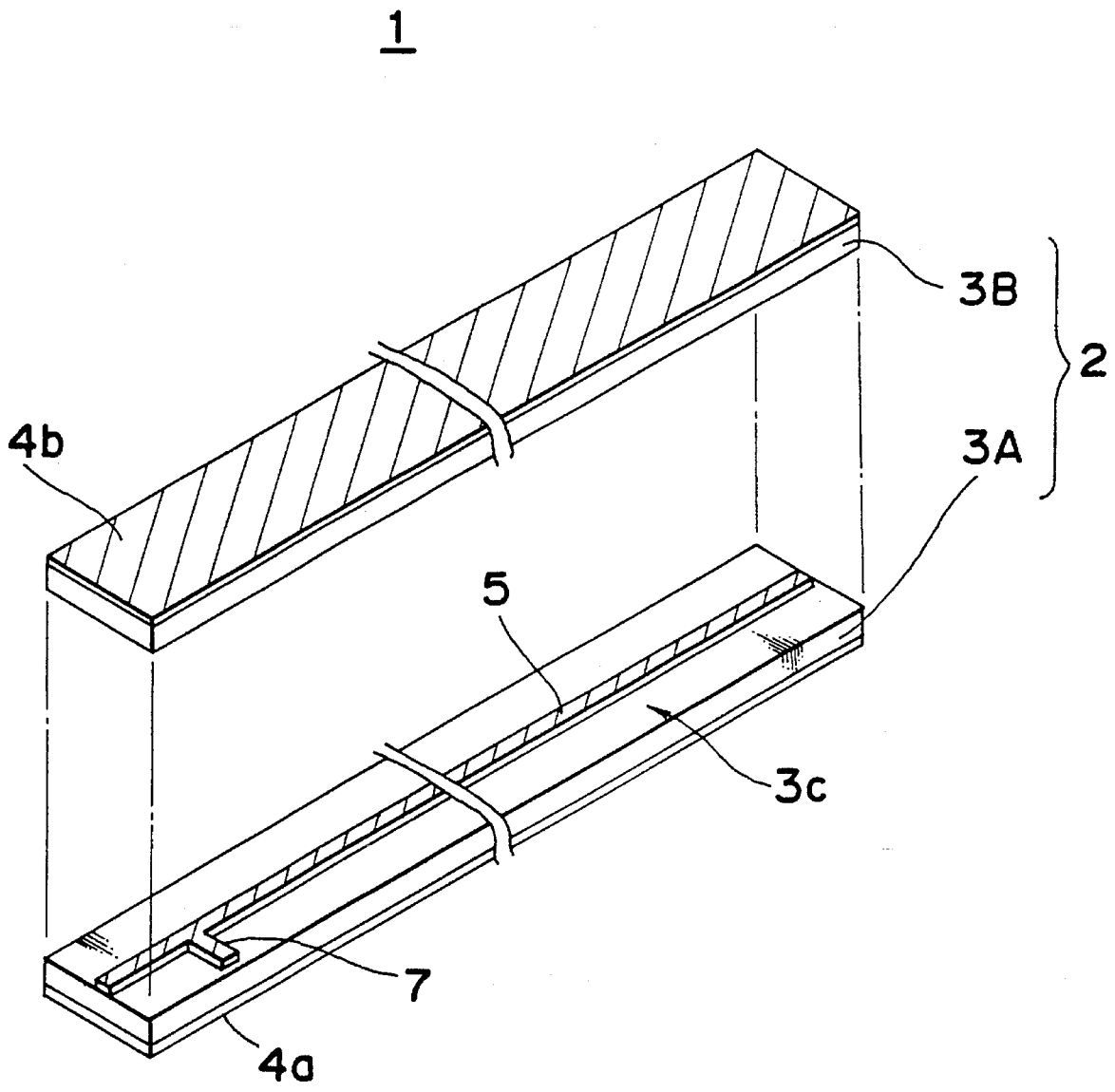
FIG. 1 is an exploded perspective view showing a construction of a triplate type high frequency parallel strip-line cable according to a first preferred embodiment of the present invention.

FIG. 1 is an exploded perspective view of a triplate type high frequency parallel strip-line cable 1 according to a first preferred embodiment of the present invention.

Referring to FIG. 1, the parallel strip-line cable 1 of the present preferred embodiment comprises a pair of thin-film-shaped lower and upper earth electrical conductors (referred to as earth conductors hereinafter) 4*a* and 4*b* which closely oppose to each other with an inner space smaller than the width of each of the earth conductors 4*a* and 4*b*, and the inner space between a pair of earth conductors 4*a* and 4*b* is filled with a strip-shaped dielectric body 2 composed of a pair of strip-shaped lower and upper dielectric layers 3A and 3B which are integratedly formed by the sputtering method or the chemical vapor deposition method so as to be laminated.

In the inner portion of the dielectric body 2, a thin-film-strip-shaped center electrical conductor (referred to as a center conductor hereinafter) 5 having a width smaller than the width of each of the earth conductors 4*a* and 4*b* is buried on the upper surface 3*c* of the lower dielectric layer 3A so that the distance between the center conductor 5 and the earth conductor 4*a* is substantially the same as that between the center conductor 5 and another earth conductor 4*b*. In this case, the center conductor 5 is provided between a pair of strip-shaped dielectric layers 3A and 3B, and extends in a longitudinal direction of the parallel strip-line cable 1 which is a transmission direction of a high frequency signal so as to be surrounded by a pair of earth conductors 4*a* and 4*b* through the dielectric body 2.

Further, as shown in FIG, 1, on the left side of the center electrical conductor 5, there is formed a stub 7 so as to be integratedly connected with the center conductor 5, and so that the longitudinal direction of the center conductor 5 is perpendicular to that of the stub 7. It is to be noted that the center conductor 5 and the stub 7 are simultaneously formed by one conductor forming process. As a result, the parallel strip-line 1 is assembled.

In this case, the stub 7 operates as a reactance of an impedance matching device part for the center conductor 5. Therefore, the parallel strip-line cable 1 comprises the impedance matching device part in the inner part thereof. The stub 7 provides an impedance matching between the parallel strip-line cable 1, and an electrical component connected with the end of the parallel strip-line cable 1, such as an antenna for transmitting and receiving a high frequency signal, and further provides another impedance matching between electrical components which are connected with both ends of the parallel strip-line cable 1.

The dielectric body 2 is preferably made of an electrically insulating dielectric material having a flexibility or a plasticity, and the center conductor 5 is made of an electrical conducting material such as a Cu foil or the like, so that the parallel strip-line cable 1 has either a flexibility or a plasticity, respectively.

In the present preferred embodiment, the thickness of each of strip-shaped dielectric layers 3A and 3B is preferably 0.25 mm, the thickness of each of the conductor 5, 4*a* and 4*b* is preferably 5 μm. In this case, the thickness of the parallel strip-line cable 1 becomes about 0.26 mm.

When each of the strip-shaped dielectric layers 3A and 3B is made of a fluoride resin such as an ethylene tetrafluoride resin or the like, the assembled parallel strip-line cable 1 has a flexibility. On the other hand, when each of the dielectric layers 3A and 3B is made of a polypropylene resin, the assembled parallel strip-line cable 1 has a plasticity.

Since the parallel strip-line cable 1 of the preferred embodiment has the flexibility or the plasticity much more than those of the conventional coaxial cable, the parallel strip-line cable 1 can be used for wiring in small spaces between a case and a printed circuit board, and also wiring with a high density on or between electrical components or devices formed on a dielectric or semiconductor substrate. When using the conventional coaxial cable, the whole length thereof tends to become longer since it has not a relatively large flexibility or a relatively large plasticity. Accordingly, an efficient wiring can be obtained when using the parallel strip-line cable 1 of the present invention.

Second Preferred Embodiment

Figure 2:
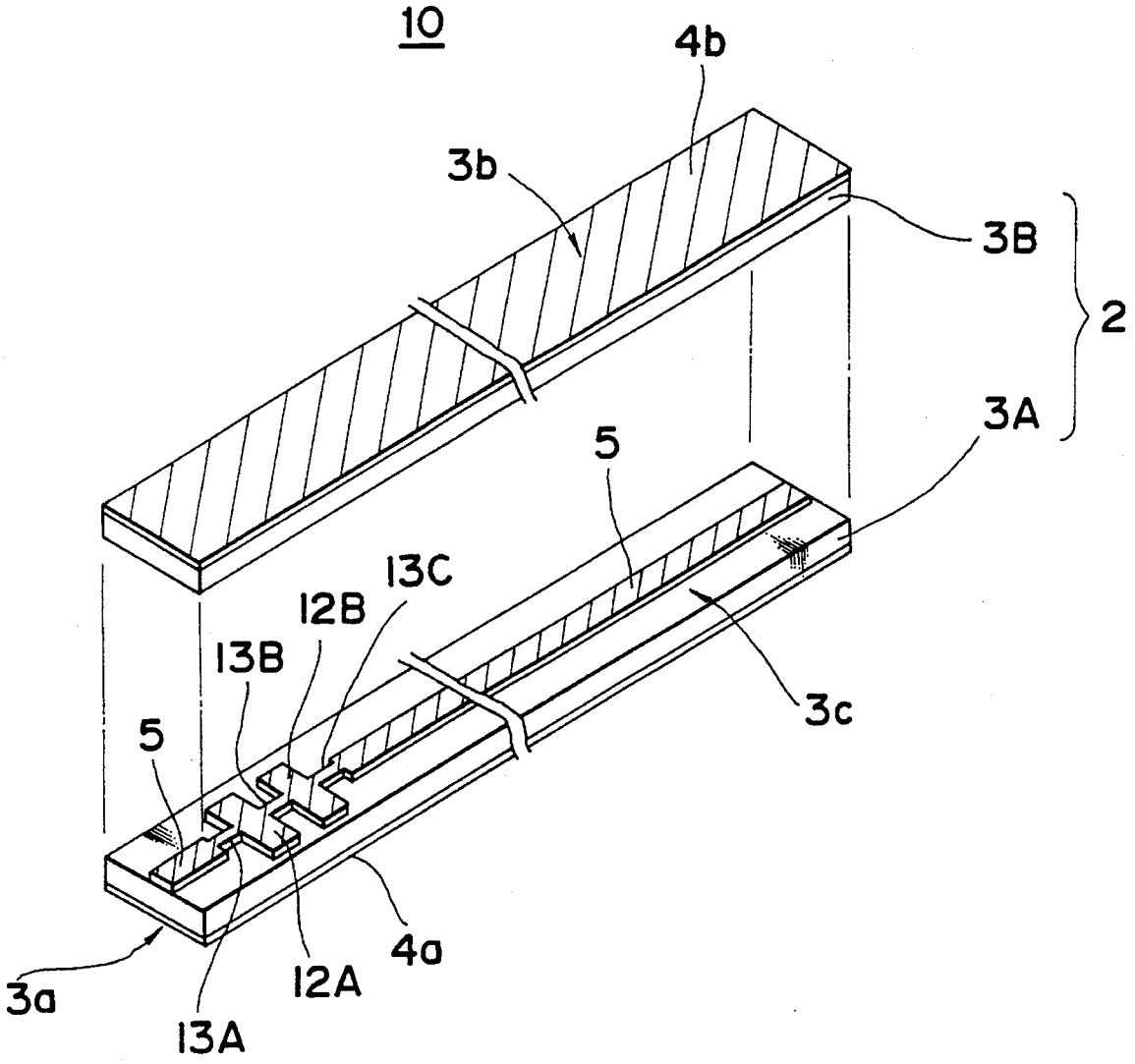
FIG. 2 is an exploded perspective view showing a construction of a triplate type high frequency parallel strip-line cable according to a second preferred embodiment of the present invention.

FIG. 2 is an exploded perspective view of a triplate type high frequency parallel strip-line cable 10 according to a second preferred embodiment of the present invention. The parallel strip-line cable 10 is characterized in comprising a LC low-pass filter inside of the cable 10.

Referring to FIG. 2, the parallel strip-line cable 10 has a strip-shaped dielectric body 2 made of either an electrical insulating dielectric material having a flexibility such as an ethylene tetrafluoride resin or the like, or another electrical insulating dielectric material having a plasticity such as polypropylene or the like, and is composed of a pair of strip-shaped lower and upper dielectric layers 3A and 3B, which are integratedly formed so as to be laminated.

Further, a pair of thin-film-shaped lower and upper earth conductors 4*a* and 4*b* each made of Cu foil is formed on the opposing outer surfaces 3*a* and 3*b* of the dielectric layers 3A and 3B, respectively. A center conductor 5 made of Cu foil is further formed on the upper surface 3*c* of the lower dielectric layer 3A. This construction is the same as that in the first preferred embodiment.

The parallel strip-line cable 10 further comprises a low-pass filter circuit device part inside thereof. More specifically, on the left end side of the center electrical conductor 5 in FIG. 2, there are formed on the upper surface 3*c* of the dielectric layer 3A, not only a pair of capacitive electrode pads 12A and 12B each having a width larger than that of the center conductor 5 so that the center conductor 5 is extended to both sides thereof in the width direction, but also three narrow-width portions 13A, 13B and 13C each having a width smaller than that of the center so that the width of the center conductor 5 is reduced. It is to be noted that the above-mentioned center conductor 5, the narrow-width portions 13A, 13B and 13C and the capacitive electrode pads 12A and 12*b* are simultaneously formed by one conductor forming process.

Between the center conductors 5 of both sides, there are electrically connected in series, the narrow-width portion 13A, the capacitive electrode pad 12A, the narrow-width portion 13B, the capacitive electrode pad 12B, and the narrow-width portion 13C. In this case, each of the dielectric body 2 located between the capacitive electrode pad 12A and the earth conductors 4*a* and 4*b* and the dielectric body 2 located between the capacitive electrode pad 12B and the earth conductors 4*a* and 4*b* operates as a capacitor C since the dimensions of each pad per a unit length in the longitudinal direction of the center conductor 5 is larger than those of the center conductor 5. Further, each of the narrow-width portions 13A, 13B and 13C operates as an inductance coil L. As a result, the LC circuit composed of these capacitors C and these inductance coil L constitutes the low-pass filter device part, which serves to eliminate or cut off high frequency components such as high frequency signals, high frequency noise or the like, which are transmitted through the parallel strip-line cable 10.

When the dielectric body 2 is made of a fluoride resin such as an ethylene tetrafluoride resin, the parallel strip-line cable 10 has a flexibility, while when the dielectric body 2 is made of a polypropylene resin, the parallel strip-line cable 10 has a plasticity.

In the present preferred embodiment, the low-pass filter is provided in the parallel strip-line cable 10, however, the present invention is not limited to this. The other type filter such as a high-pass filter, a band-elimination filter, a band-pass filter or the like may be formed in the parallel strip-line cable 10.

Third Preferred Embodiment

Figure 3A:
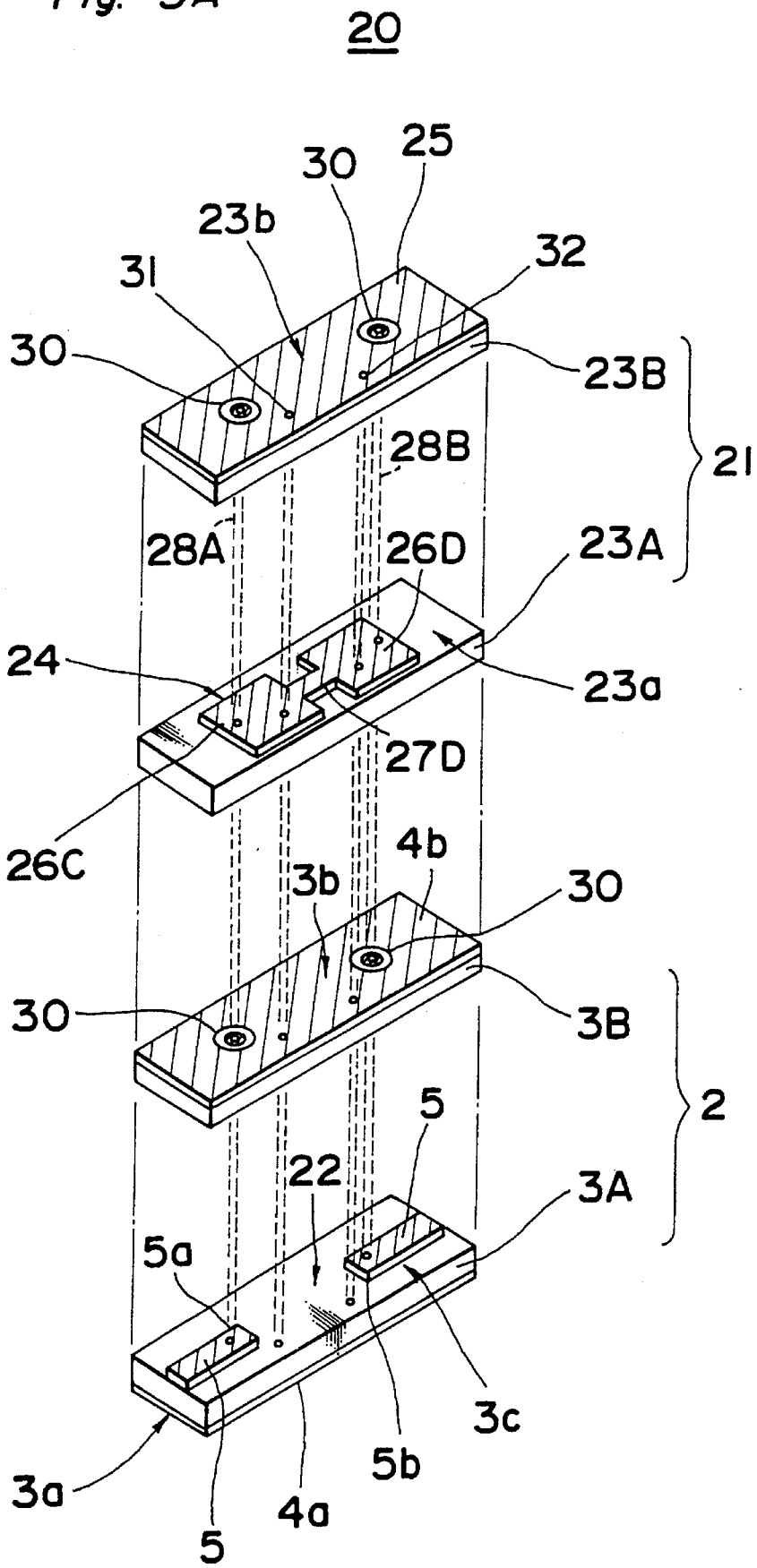
FIG. 3A is an exploded perspective view showing a construction of a multi-plate type high frequency parallel strip-line cable according to a third preferred embodiment of the present invention.

FIG. 3A is an exploded perspective view of a multi-plate type high frequency parallel strip-line cable 20 according to a third preferred embodiment of the present invention. The parallel strip-line cable 20 is characterized in comprising a π type attenuator circuit device part inside of the cable 20.

The parallel strip-line cable 20 of the present preferred embodiment comprises a strip-shaped main dielectric body 2 made of either an electrical insulating dielectric material having a flexibility such as an ethylene tetrafluoride resin or the like, or another electrical insulating dielectric material having a plasticity such as polypropylene or the like, and is composed of a pair of strip-shaped lower and upper dielectric layers 3A and 3B, which are integratedly formed so as to be laminated.

Further, a pair of thin-film-shaped earth conductors 4*a* and 4*b* made of Cu foil is formed on the opposing outer surfaces 3*a* and 3*b* of the lower and upper dielectric layers 3A and 3B. Two pieces of a thin-film-shaped center conductor 5 made of Cu foil are formed on the upper surface 3*c* of the lower dielectric layer 3A, namely, an unformed portion 22 where the center conductor 5 is not formed is formed by cutting off the middle portion of the center conductor 5. This construction is the same as that in the first and second preferred embodiments except for the two pieces of the center conductor 5.

The parallel strip-line cable 20 further comprises a sub-dielectric body 21 made of either an electrical insulating dielectric material having a flexibility such as an ethylene tetrafluoride resin or the like, or another electrical insulating dielectric material having a plasticity such as polypropylene or the like, and is composed of a pair of strip-shaped lower and upper dielectric layers 23A and 23B, which are integratedly formed so as to be laminated, in a manner similar to that of the main dielectric body 2.

Furthermore, a thin-film-shaped circuit device electrical resistive pattern (referred to as a circuit device pattern hereinafter) 24 made of an electrical resistive material such as carbon, cermet or the like is formed on the upper surface 23*a* of the lower dielectric layer 23A so as to be located above the unformed portion 22, while a thin-film-shaped earth conductor 25 made of Cu foil is formed on the entire upper surface 23*b* of the upper dielectric layer 23B.

The circuit device pattern 24 of the electrical resistive material comprises a pair of resistance pads 26C and 26D, and a narrow-width portion 27D having a width smaller than that of each of the resistive pads 26C and 26D. The narrow-width portion 27D is disposed between the resistance pads 26C and 26D, so that the resistive pad 26C, the narrow-width portion 27D and the resistive pad 26D are electrically connected in series with each other. In this case, the circuit device pattern 24 operates as the π type resistance circuit device.

In the circuit device pattern 24, the resistance pads 26C and 26D are formed so that the width of each of the resistance pads 26C and 26D is larger than that of the center conductor 5, while the narrow-width portion 27D is formed so that the width of the narrow-width portion 27D is smaller than that of the center conductor 5. The circuit device pattern 24 is formed so that the length in the longitudinal direction of the circuit device pattern 24 is slightly larger than that of the unformed portion 22.

With the circuit device pattern 24 positioned above the unformed portion 22, the sub-dielectric body 21 is formed so as to be integratedly laminated on the upper dielectric layer 3B of the main dielectric body 2. Further, the main and sub-dielectric bodies 2 and 21 formed so as to be integratedly laminated in this way have through-holes 28A and 28B penetrating in the thickness direction through the main and sub-dielectric bodies 2 and 21. More specifically, in the state that the main and sub dielectric bodies 2 and 21 are integratedly laminated, the resistance pads 26C and 26D provided at both ends of the narrow-width portion 27D are disposed upward of open ends 5*a* and 5*b* of the center conductor 5, respectively. Then, the open ends 5*a* and 5*b* of the center electrical conductor 5 are respectively connected with the resistance pads 26C and 26D by through-hole conductors formed by Cu plating the inner surfaces of the through-holes 28A and 28B which range over at least between the resistance pads 26C and 26D, and the open ends 5*a* and 5*b* of the center conductor 5. In a manner similar to that of the through-holes 28A and 28B, through-holes 31 and 32 are formed so as to penetrate through the dielectric bodies 2 and 21, the earth conductor 4*b* and the resistance pads 26C and 26D, and then though-hole conductors are formed by Cu plating the inner surfaces of the through-holes 31 and 32 which range over at least between the earth conductors 4*a* and 25, wherein a point of the resistance pad 26C and a point of the resistance pad 26D are connected through the though-hole conductors with the earth conductor 25, 4*a* and 4*b*, respectively.

On the other hand, the through-holes 28A and 28B are disposed so as to penetrate the earth conductors 4*a*, 4*b* and 25 of the dielectric layers 3A, 3B and 23B, respectively, the earth conductors 4*a*, 4*b* and 25 are provided with a cut portion 30 at the positions where the through-holes are located, so that the Cu plating applied to the through-holes 28A and 28B will never cause any connection of the resistance pad 26C and the open end 5*a* of the center conductor 5 with the earth conductors 4*a*, 4*b* and 25, and any connection of the resistance pad 26D and the open end 5*b* of the center conductor 5 with the earth conductors 4*a*, 4*b* and 25.

With the through-holes 28A and 28B formed in this way, the circuit device pattern 24 is connected in series between the two pieces of the center electrical conductor 5. In this case, the resistance pad 26C located between the through-hole 31 and the through-hole 28A constitutes a first parallel resistance, while the resistance pad 26D located between the through-hole 32 and the through-hole 28B constitutes a second parallel resistance, wherein changing of the positions of the though-holes 31 and 32 leads to change in the first and second resistances. On the other hand, the resistance pads 26C and 26D and the narrow-width portion 27D located between the through holes 28A and 28B constitutes a series resistance, wherein changing of the width of the narrow-width portion 27*d* leads to change in the series resistance. As a result, the π type attenuator circuit device is obtained. In this case, the former changing of the first and second parallel resistances leads to change in the cable impedance, while the latter changing of the series resistance leads to change in the attenuation factor of the π type attenuator circuit device.

When each of the dielectric bodies 2 and 21 is made of a fluoride resin such as an ethylene tetrafluoride resin or the like, the parallel strip-line cable 20 has a flexibility, while when each of the dielectric bodies 2 and 21 is made of a polypropylene resin, the parallel strip-line cable 20 has a plasticity.

Figure 3B:
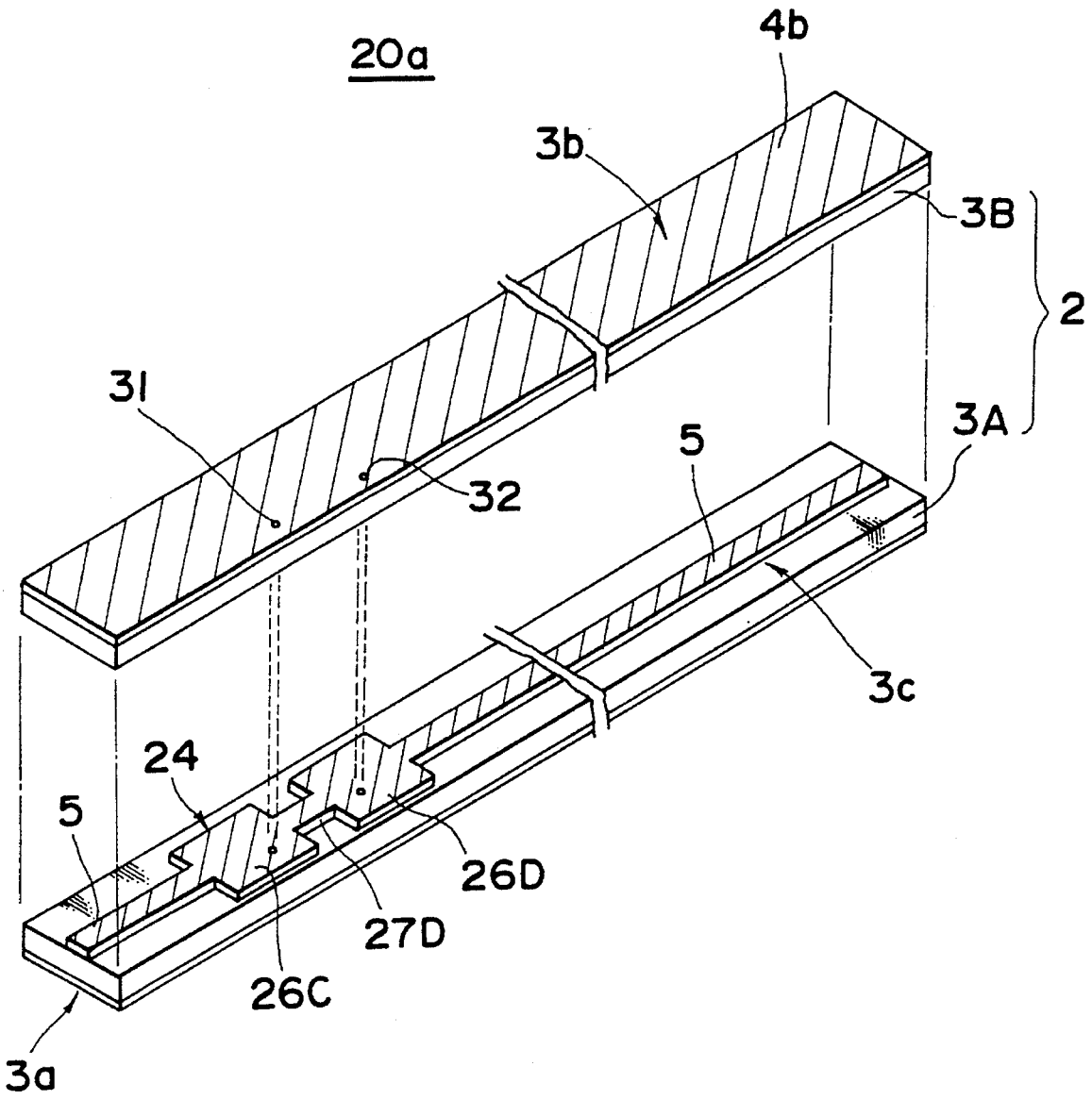
FIG. 3B is an exploded perspective view showing a construction of a triplate type high frequency parallel strip-line cable of a modification of the multi-plate type high frequency parallel strip-line cable shown in FIG. 3A.

FIG. 3B shows a modification of the third preferred embodiment. Referring to FIG. 3B, the circuit device pattern 24 may be formed on the upper surface 3*c* of the lower dielectric layer 3A, and then there are connected in series the followings:

(a) one piece of the center conductor 5;

(b) the resistance pad 26C;

(c) the narrow-width portion 27D;

(d) the resistance pad 26D; and (e) another piece of the center conductor 5, namely, the circuit device pattern 24 is formed so as to be electrically connected between the two pieces of the center conductor 5. Further, the through-holes 31 and 32 are formed so as to penetrate the dielectric body 2, and then the though-hole conductors formed by Cu plating the inner surfaces of the through holes 31 and 32 connect predetermined points of the respective resistance pads 26C and 26D with the earth conductors 4*a* and 4*b*, respectively. As a result, the π type attenuator circuit device is obtained in the triplate type parallel strip-line cable 20*a* of the modification of the third preferred embodiment.

In the third preferred embodiment and the modification thereof, the $\pi$ type attenuator device is formed in the parallel strip-line cables 20 and 20*a*, however, the present invention is not limited to this. The other type attenuator may be formed in the parallel strip-line cables 20 and 20*a*.

Fourth Preferred Embodiment

Figure 4:
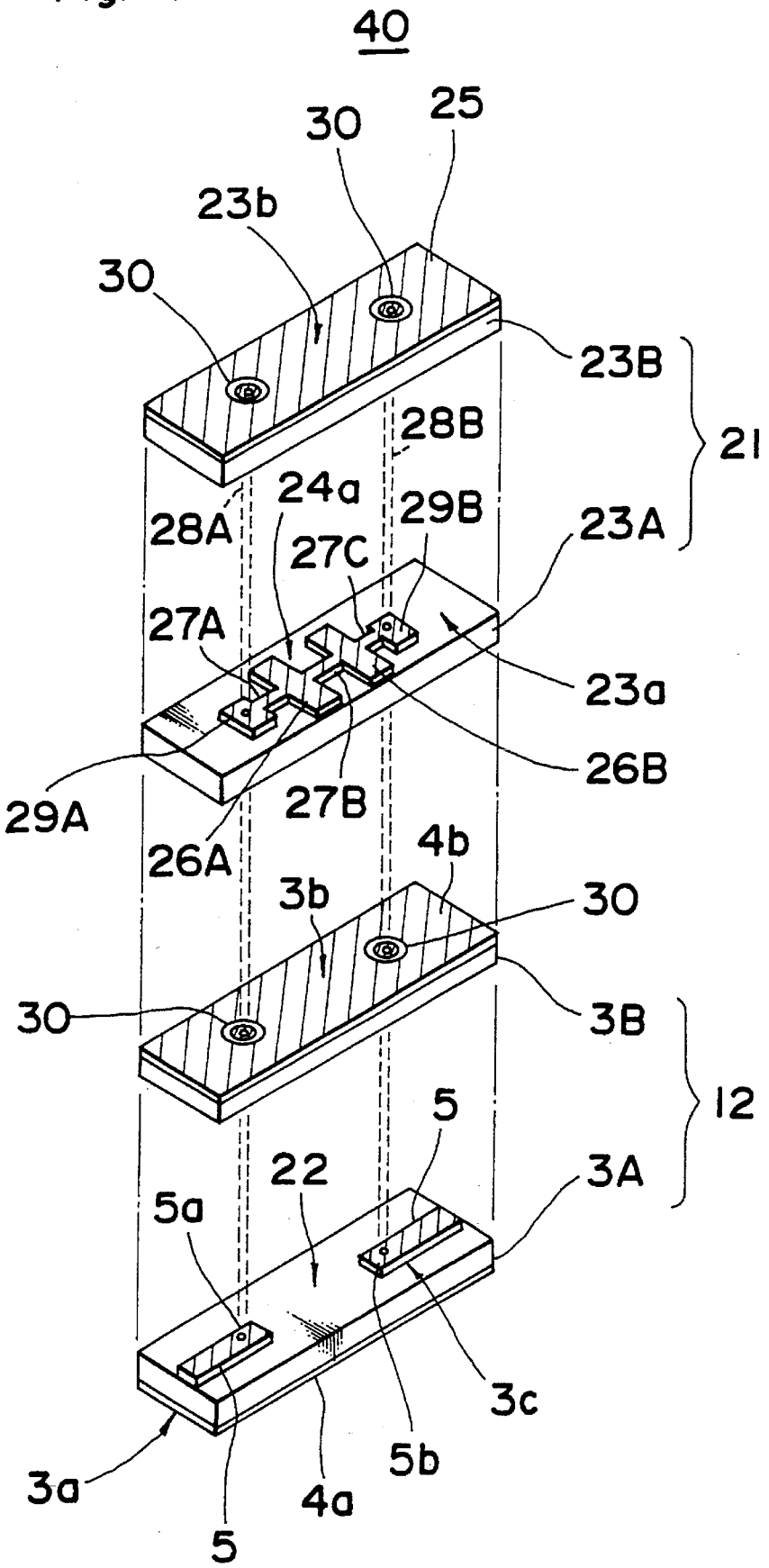
FIG. 4 is an exploded perspective view of a construction of a multi-plate type high frequency parallel strip-line cable according to a fourth preferred embodiment of the present invention.
Figure 5:
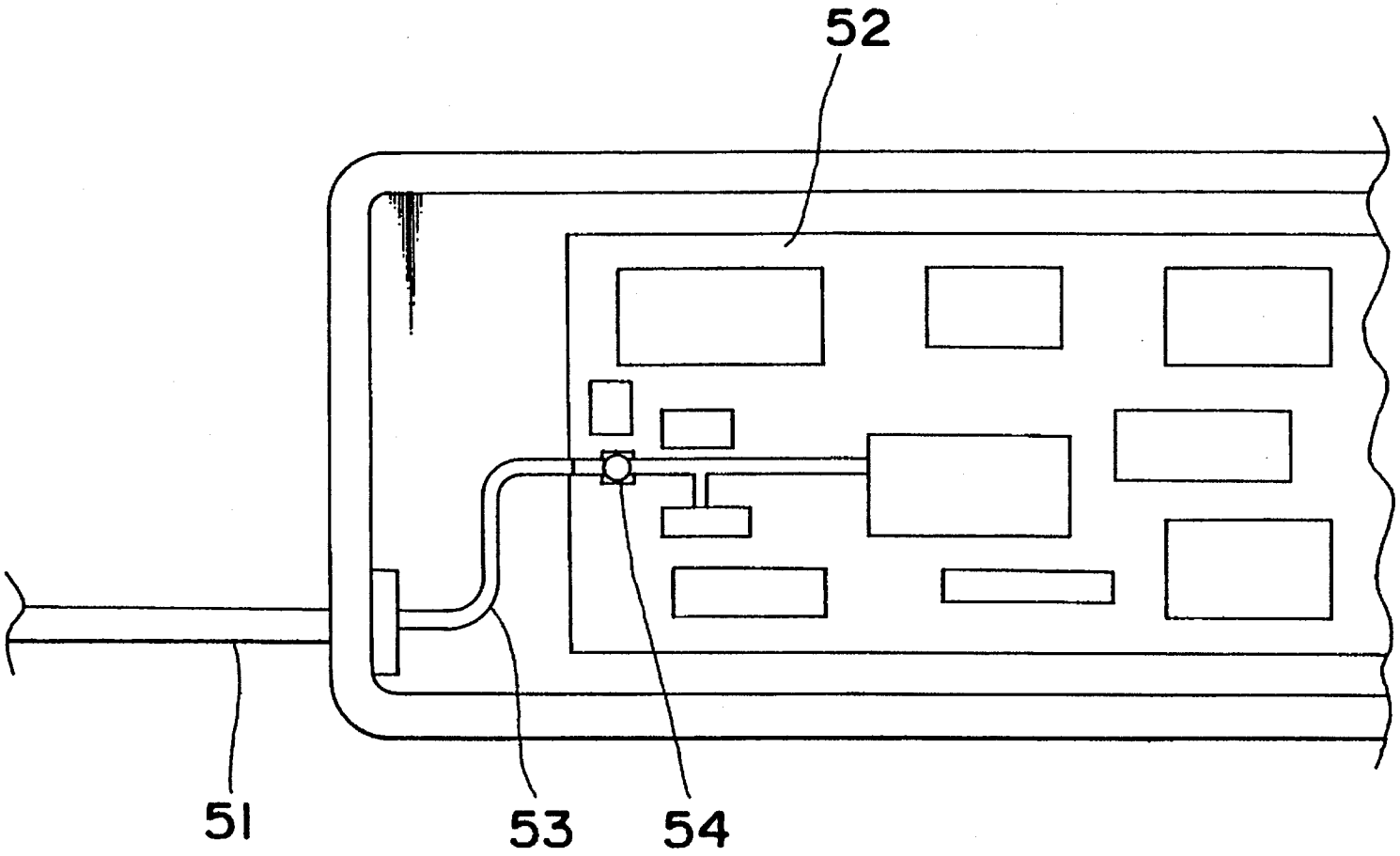
Fig. 5 PRIOR ART
FIG. 5 is a plan view of a small-sized high frequency apparatus using a conventional coaxial cable.

FIG. 4 is an exploded perspective view of a multi-plate type parallel strip-line cable 40 according to a fourth preferred embodiment of the present invention. The parallel strip-line cable 40 has the same structure as that of the parallel strip-line cable 30 of the third preferred embodiment, except for that the circuit device pattern 24 is replaced with a circuit device pattern 24*a* having an electrical conducting material such as Cu foil or the like, and therefore, only the differences between the second and fourth preferred embodiments will be described below.

The circuit device pattern 24*a* comprises a connection pad 29A, a narrow-width portion 27A, a capacitive electrode pad 26A, a narrow-width portion 27B, a capacitive electrode pad 26B, a narrow-width portion 27C and a connection pad 29B, which are electrically connected in series. The width of each of the narrow-width portions 27A, 27B and 27C is smaller than that of the center conductor 5, and the width of each of the capacitive electrode pads 26A and 26B is larger than that of the center conductor 5, in a manner similar to that of the second preferred embodiment.

The connection pad 29A is electrically connected with the open end 5*a* of the center conductor 5 through the through-hole conductor formed by Cu plating the inner surface of the through-hole 28A, while the connection pad 29B is electrically connected with the open end 5*b* of the center conductor 5 through the through-hole conductor formed by Cu plating the inner surface of another through-hole 28B.

In this case, the dielectric body 21 located between the capacitive electrode pad 26A and the earth conductors 25 and 4*b* and the dielectric body 21 located between the capacitive electrode pad 26B and the earth conductors 25 and 4*b* operate as capacitors C, while the narrow-width portions 27A, 27B and 27C operate as inductance coils L, respectively. Therefore, these LC circuit elements of the circuit device pattern 24*a* constitute a low-pass filter in a manner similar to that of the second preferred embodiment.

When each of the dielectric bodies 2 and 21 is made of a fluoride resin such as an ethylene tetrafluoride resin or the like, the parallel strip-line cable 40 has a flexibility, while when each of the dielectric bodies 2 and 21 is made of a polypropylene resin, the parallel strip-line cable 40 has a plasticity.

Among the dielectric layers constituting the dielectric layers of each capacitor, the upper dielectric layer 3B of the main dielectric body 2 constitutes the main transmission line, and therefore it is difficult to arbitrarily set the dielectric constant and the thickness of the upper dielectric layer 3B. However, the dielectric layers 23A and 23B constituting the sub-dielectric body 21 do not directly constitute the main transmission line, so that their dielectric constant and thickness can be set relatively arbitrarily. Thus, by changing the dielectric constant and the thickness of the dielectric layers 23A and 23B, the characteristics of the low-pass filter circuit element portion can be designed relatively arbitrarily.

In particular, when the dielectric body 21 has a higher dielectric constant, the capacitors formed by the capacitive electrode pads 26A and 26B can be constituted so as to have a higher capacitance even though the dimensions thereof become smaller, particularly, in the longitudinal direction since the width of these elements are determined according to the characteristic impedance. This results in the smaller-sized multi-plate type strip-line cable 40 having the low-pass filter.

The parallel strip-line cables 1, 10, 20, 20*a* and 40 of the above-described preferred embodiments are characterized in that they can be reduced in size, especially in height, namely, the thickness based on the following grounds.

More specifically, the characteristic impedance $Z_0$ of each of the parallel strip-line cables 1, 10, 20, 20*a* and 40 can be determined as follows:

(a) it is determined by the following Equation (1) when $W/(b-t) \geqq 0.35$; and (b) it is determined by the following Equation (2) when $W/(b-t) < 0.35$, $t/b \geqq 0.25$, and $t/W \geqq 0.11$. It is noted that the capacitance Cf in the Equation 1 can be determined by the following Equation (3), and the value $\alpha_0$ in the Equation (3) can be determined by the following Equation (4).

$$Z_0 = \frac{94.15}{\sqrt{\epsilon r}\left[\frac{W/b}{(1-t/b)} + \frac{Cf}{0.00885 \cdot \epsilon r}\right]} \tag{1}$$

$$Z_0 = \frac{60}{\sqrt{\epsilon r}} \cdot \ln\left(\frac{4 \cdot b}{\pi \cdot \alpha_0}\right) \tag{2}$$

$$Cf = \frac{0.00885 \cdot \epsilon r}{\pi}\left[\frac{2}{(1-t/b)} \cdot \ln\left\{\frac{1}{(1-t/b)} + 1\right\} - \left\{\frac{1}{(1-t/b)} - 1\right\} \cdot \ln\left\{\frac{1}{(1-t/b)^2} - 1\right\}\right] \tag{3}$$

$$\alpha_0 = \frac{W}{2}\left[1 + \frac{t}{\pi W}\left\{1 + \ln\frac{4\pi W}{t}\right\} + 0.51\left(\frac{t}{W}\right)^2\right] \tag{4}$$

where $Z_0$ is the characteristic impedance of the cable,

W is the width of the center conductor 5, t is the thickness of the center conductor 5, $\epsilon r$ is the dielectric constant of the dielectric body or main dielectric body 2, and b is the thickness of the dielectric body or the main dielectric body 2.

As apparent from these equations (1) to (4), when the characteristic impedance $Z_0$ is a constant, thinning the thickness t of the center electrical conductor 5 allows the thickness b of the dielectric body or the main dielectric body 2 to become steeply smaller. Since the center conductor 5 constituting the parallel strip-line cables 1, 10, 20, 20*a* and 40 can be made of a thin film by a film forming method such as the sputtering method, the chemical vapor deposition method, or the like their thickness t can be easily thinned. Accordingly, setting the thickness of the center electrical conductor 5 to a smaller value allows the height or the thickness of the whole parallel strip-line cable to be reduced. For example, if the parallel strip-line cables 1, 10, 20, 20*a* and 40 having a characteristic impedance of 50 Ω are designed by using a fluorocarbon resin having a relative dielectric constant $\epsilon r$ of 2.04 as the dielectric body or main dielectric body 2, the center electrical conductor 5 can be set to a width W of 0.2 mm and a thickness t of 0.005 mm while the dielectric body or main dielectric body 2 can be set to a thickness b of 0.25 mm. Then, if the thickness of each of the earth conductors 4*a* and 4*b* is set to 0.005 mm which is the same as that of the center conductor 5, the whole thickness of the parallel strip-line cables 1, 10 and 20*a*, and a main transmission line part of the cable 20 and 40 becomes approximately 0.26 mm. This value is about one half of the outer diameter of a coaxial cable having the equivalent performance.

Within the parallel strip-line cables whose height can be reduced on the above-described grounds, a circuit element portion is disposed such as the impedance adjusting circuit device part, the attenuator circuit device part, or the low-pass filter circuit device part as described above. As a result, the parallel strip-line cables, if it is incorporated into the high frequency apparatus, allow a smaller-sized high frequency apparatus having a higher performance to be implemented.

Further, the parallel strip-line cable of the present invention is not limited to those disclosed in the above preferred embodiments. However, the entire peripheral surface of the dielectric body may be covered with the earth conductors so as to be shielded for the purpose of preventing leakage of electromagnetic waves, or the whole parallel strip-line cable may be covered with an dielectric film, thereby ensuring electrical insulation against the other members.

Furthermore, the circuit device part to be provided in the parallel strip-line cable is not limited to the impedance adjusting circuit device part, the attenuator circuit device part, or the low-pass filter circuit device part as described in the above-mentioned preferred embodiments, but it may of course be another circuit element part, such as a phase adjusting circuit device part or the like.

As described above, according to the present invention, since the multi-plate type parallel strip-line cable is formed with the additional circuit device part, and has either a plasticity or flexibility, the parallel strip-line cable or the small-sized high frequency apparatus into which the parallel strip-line cable is incorporated can be provided with advanced performance by virtue of added electrical functions of the additional circuit device part. Further, for such advanced performance, the circuit device part is integratedly formed so as to be incorporated into the parallel strip-line cable, and then the parallel strip-line cable is installed inside of the small-sized high frequency apparatus. This results in that the circuit device is no longer required to be installed within the small-sized high frequency apparatus as a hybrid device component. As a result, the size of the small-sized high frequency apparatus can be reduced. Accordingly, the high frequency parallel strip-line cable has such a remarkably advantageous effect that the high frequency apparatus can be provided with advanced performance without enlarging the size of the whole construction of the high frequency apparatus.

Figure 6:
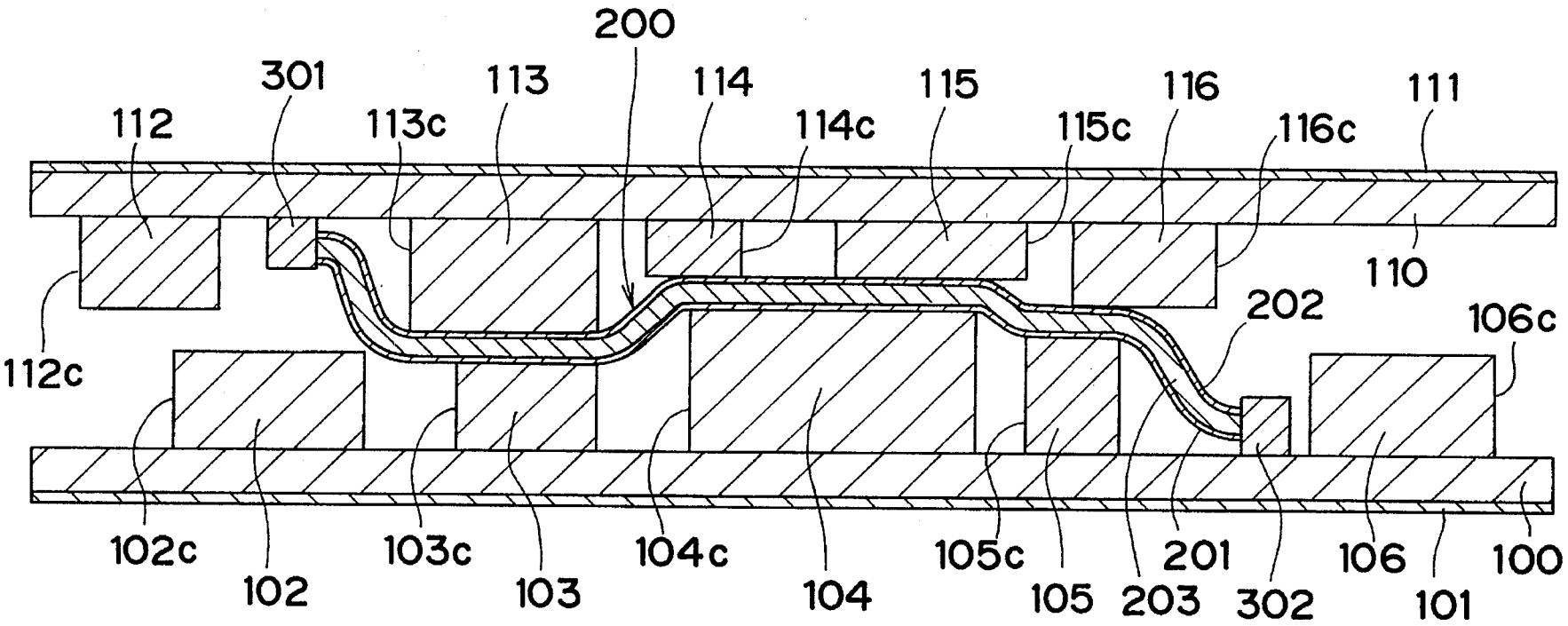
FIG. 6 shows a further preferred embodiment of a mount arrangement of a triplate high frequency parallel strip-line cable.
Figure 7:
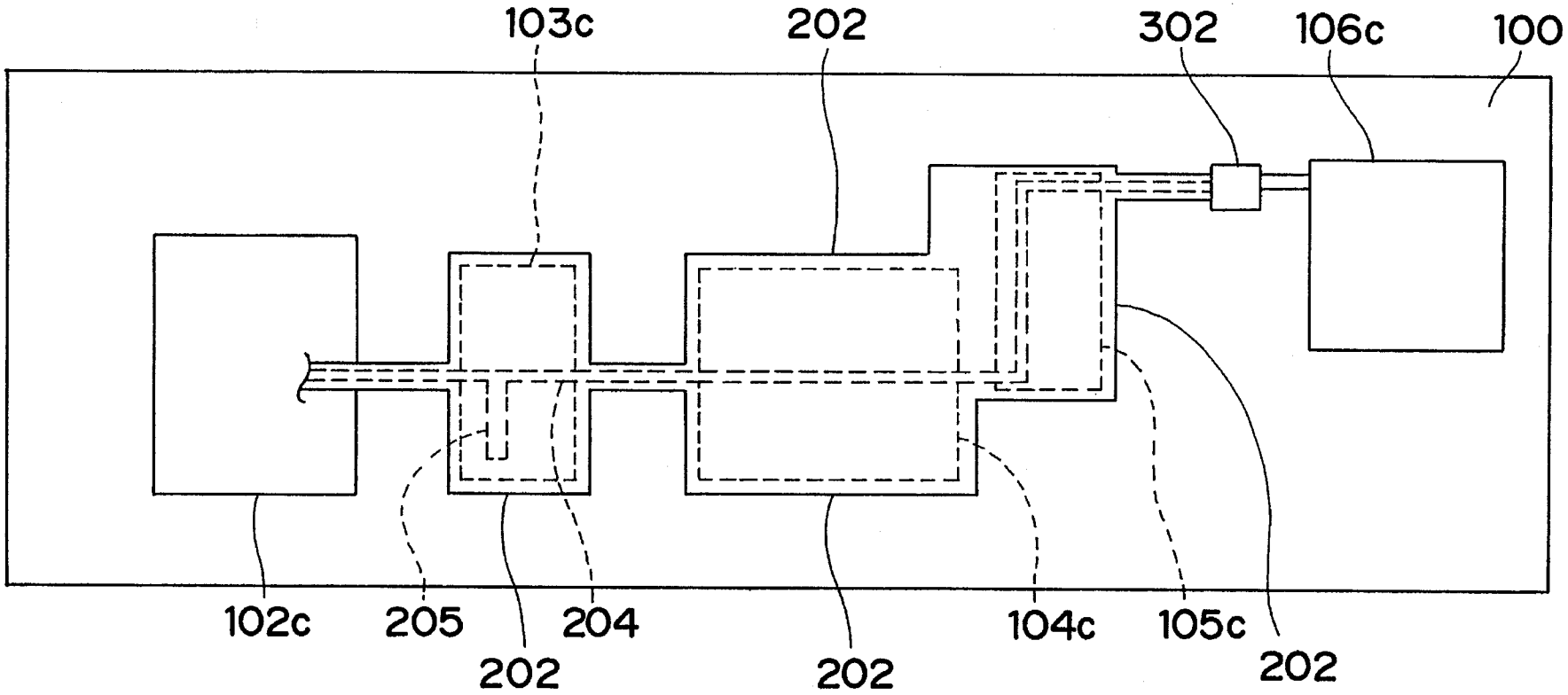
FIG. 7 is a partly cut-away plan view of the embodiment of FIG. 7.

FIG. 6 shows a further preferred embodiment of a mount arrangement of a triplate high frequency parallel strip-line cable 200 mounted between a printed circuit board 100 for a radio frequency circuit and a printed circuit board 110 for a logical controller circuit, which are for use in a portable telephone, and FIG. 7 is a plan view of the printed circuit board 100 when the printed circuit board 110 is removed.

Referring to FIG. 6, an earth conductor 101 is formed on a first surface of the printed circuit board 100, and a low-noise amplifier 102 for a high frequency amplifier section of a radio receiver, intermediate frequency amplifiers 103 and 105, a mixer 104 and a high frequency power amplifier 106 of a radio transmitter are mounted on a second surface of the printed circuit board 100. On the other hand, an earth conductor 111 is formed on a first surface of the printed circuit board 110, and a voltage controlled oscillator 112, a digital signal processor 113, a RAM 114, a CPU 115 for controlling the whole operation of the portable telephone and a ROM 116 are mounted on a second surface of the printed circuit board 110.

In the preferred embodiment, the printed circuit boards 100 and 110 are supported by supporting members (not shown) provided in a dielectric plastic case (not shown) of the portable telephone.

Shield earth cases 102*c*–106*c* and 112*c*–116*c* are provided so as to cover the circuit devices 102–106 and 112–116 in order to electromagnetically protect the same inner circuit devices 102–106 and 112–116 from outer unnecessary interference waves. In this case, the shield earth cases 102*c*–106*c* are electrically connected to the earth conductor 101, and the shield earth cases 112*c*–116*c* are electrically connected to the earth conductor 111.

The triplate high frequency strip-line cable 200 is constituted by forming the cable 200 in a manner similar to that of the triplate high frequency strip-line cables 1 and 10 of the first and second preferred embodiments shown in FIGS. 1 and 2. The triplate strip-line cable 200 comprises a strip-shaped dielectric body 203 made of a fluoride resin having a flexibility which is formed between a pair of thin-film-shaped earth conductors 201 and 202 so as to oppose to each other, and further comprises a thin-film-shaped center conductor 204 (shown in FIG. 7) formed in the dielectric layer 203 so as to be located between said pair of earth conductors 201 and 202.

Referring to FIG. 7, in the triplate strip-line cable 200, as stub 205 for impedance adjustment is connected to the center conductor 204, and therefore, the triplate strip-line cable 200 comprises an impedance adjustment circuit. In the present invention, the triplate strip-line cable 200 is not limited to this, and may comprise either an attenuator circuit, a filter circuit, an inductance, a resistance, or a capacitance.

In order to prevent unnecessary electromagnetic waves generated by the circuit devices 103, 104 and 105 from projecting onto the circuit devices 112–116 mounted on the printed circuit board 110, as shown in FIG. 7, the triplate strip-line cable 200 has different widths depending on the sizes of the shield earth cases 103*c*–105*c* of the circuit devices 103–105, namely, has a width slightly larger than that of the shield case 103*c*, a width slightly larger than that of the shield case 104*c*, and a width slightly larger than that of the shield case 105*c*.

The triplate strip-line cable 200 is mounted between the printed circuit boards 100 and 110 so as to be curved so that the surface of the printed circuit board 100 on which the circuit devices 102–106 are mounted opposes the surface of the printed circuit board 110 on which the circuit devices 112–116 are mounted. In this case, the earth conductor 201 of the cable 200 is in electrical contact with the shield earth cases 103*c*–105*c*, and the earth conductor 202 of the cable 200 is in electrical contact with the shield earth cases 113*c*–116*c*.

These electrical contacts make earth electric 10 potentials of the earth conductors 101, 111, 201 and 202 be equal to each other.

Further, one end of the cable 200 is electrically connected to a connector 301 mounted on the printed circuit board 110, and another end of the cable 200 is electrically connected to a further connector 302 mounted on the printed circuit board 100. In the connector 301, the earth conductor 111 is electrically connected to the earth conductor 201 and 202. On the other hand, in the connector 302, the earth conductor 101 is electrically connected to the earth conductor 201 and 202.

As described above, since the cable 200 is flexible, the cable 200 is mounted between the printed circuit board 100 for the radio frequency circuit and the printed circuit board 110 for the logical controller circuit, and further, the printed circuit board 110 is shielded from the printed circuit board 100 by the earth conductors 201 and 202 of the cable 200. Further, the printed circuit board 100 is electrically connected through the cable 200 to the printed circuit board 110.

Figure 8:
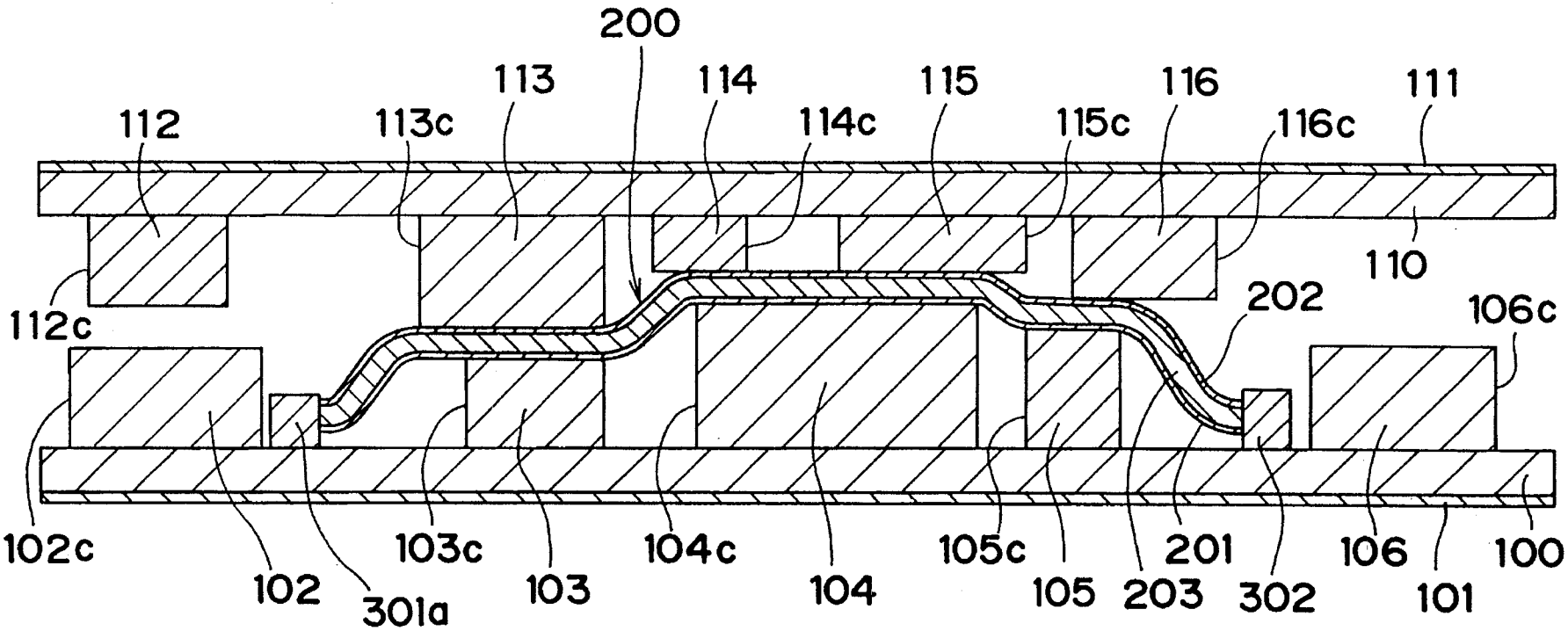
FIG. 8 shows yet another preferred embodiment of a mount arrangement of a triplate high frequency parallel strip-line cable.

In a further preferred embodiment, as shown in FIG. 8, one end of the cable 200 may be electrically connected to a connector 301*a* mounted on the printed circuit board 100, and another end of the cable 200 is electrically connected to a further connector 302 mounted on the printed circuit board 100.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A mount arrangement of a triplate high frequency parallel strip-line cable, wherein said triplate high frequency parallel strip-line cable comprises:

a strip-shaped dielectric body made of an electrical insulating material having a flexibility, said dielectric body composed of a pair of dielectric layers;

a pair of thin-film-shaped first and second earth conductors formed on both surfaces of said dielectric body so as to oppose to each other;

a thin-film-shaped center conductor formed between said pair of dielectric layers in said dielectric body so as to be located between said pair of earth conductors; and a line circuit device part formed between said pair of dielectric layers in said dielectric body so as to be electrically connected with said center conductor, thereby said parallel strip-line cable having a flexibility, wherein said triplate high frequency parallel strip-line cable is mounted between first and second printed circuit boards so that said first earth conductor is in electrical contact with a shield earth case of at least one circuit device mounted on said first printed circuit board, and said second earth conductor is in electrical contact with a shield earth case of at least one further circuit device mounted on said second printed circuit board, and wherein one end of said triplate high frequency parallel strip-line cable is electrically connected to a first connector mounted on said first printed circuit board, and another end of said triplate high frequency parallel strip-line cable is electrically mounted to a second connector mounted on said second printed circuit board.

2. The mount arrangement as claimed in claim 1, wherein said triplate high frequency parallel strip-line cable has different widths depending on a size of the shield earth case of at least one circuit device.

3. The mount arrangement as claimed in claim 1, wherein said dielectric body is made of a fluoride resin having a flexibility.

4. The mount arrangement as claimed in claim 1, wherein said line circuit device part comprises an impedance adjusting circuit.

5. The mount arrangement as claimed in claim 4, wherein said impedance adjusting circuit comprises a stub formed in said dielectric body so as to be connected with said center conductor.

6. The mount arrangement as claimed in claim 1, wherein said line circuit device part comprises an attenuator circuit.

7. The mount arrangement as claimed in claim 1, wherein said line circuit device part comprises a filter circuit.

8. The mount arrangement as claimed in claim 1, wherein said line circuit device part comprises an inductance.

9. The mount arrangement as claimed in claim 1, wherein said line circuit device part comprises a resistance.

10. The mount arrangement as claimed in claim 1, wherein said line circuit device part comprises a capacitance.

11. A mount arrangement of a triplate high frequency parallel strip-line cable, wherein said triplate high frequency parallel strip-line cable comprises:

a strip-shaped dielectric body made of an electrical insulating material having a flexibility, said dielectric body composed of a pair of dielectric layers;

a pair of thin-film-shaped first and second earth conductors formed on both surfaces of said dielectric body so as to oppose to each other;

a thin-film-shaped center conductor formed between said pair of dielectric layers in said dielectric body so as to be located between said pair of earth conductors; and a line circuit device part formed between said pair of dielectric layers in said dielectric body so as to be electrically connected with said center conductor, thereby said parallel strip-line cable having a flexibility, wherein said triplate high frequency parallel strip-line cable is mounted between first and second printed circuit boards so that said first earth conductor is in electrical contact with a shield earth case of at least one circuit device mounted on said first printed circuit board, and said second earth conductor is in electrical contact with a shield earth case of at least one further circuit device mounted on said second printed circuit board, and wherein one end of said triplate high frequency parallel strip-line cable is electrically connected to a first connector mounted on said first printed circuit board, and another end of the said triplate high frequency parallel strip-line cable is electrically connected to a second connector mounted on said first printed circuit board.

12. The mount arrangement as claimed in claim 11, wherein said triplate high frequency parallel strip-line cable has different widths depending on a size of the shield earth case of at least one circuit device.

13. The mount arrangement as claimed in claim 11, wherein said dielectric body is made of a fluoride resin having a flexibility.

14. The mount arrangement as claimed in claim 11, wherein said line circuit device part comprises an impedance adjusting circuit.

15. The mount arrangement as claimed in claim 14, wherein said impedance adjusting circuit comprises a stub formed in said dielectric body so as to be connected with said center conductor.

16. The mount arrangement as claimed in claim 11, wherein said line circuit device part comprises an attenuator circuit.

17. The mount arrangement as claimed in claim 11, wherein said line circuit device part comprises a filter circuit.

18. The mount arrangement as claimed in claim 11, wherein said line circuit device part comprises an inductance.

19. The mount arrangement as claimed in claim 11, wherein said line circuit device part comprises a resistance.

20. The mount arrangement as claimed in claim 11, wherein said line circuit device part comprises a capacitance.

* * * * *